United States Patent [19]

Glantschnig et al.

[11] Patent Number: 4,561,354

[45] Date of Patent: Dec. 31, 1985

[54] MULTIPLE UNIT APPARATUS FOR THE TREATMENT OF WEBS OF MATERIAL

[75] Inventors: Josef Glantschnig, Wölfnitz; Peter Gugl, Klagenfurt, both of Austria

[73] Assignee: Johannes Zimmer, Klagenfurt, Austria

[21] Appl. No.: 658,131

[22] Filed: Oct. 5, 1984

[30] Foreign Application Priority Data

Oct. 6, 1983 [AT] Austria ..... 3557/83

[51] Int. Cl.[4] ..... B41L 13/06

[52] U.S. Cl. ..... 101/120; 101/115; 101/181; 101/182

[58] Field of Search ..... 101/115, 116, 118, 119, 101/120, 181, 182

[56] References Cited

U.S. PATENT DOCUMENTS

| | | | |
|---|---|---|---|
| 2,359,825 | 10/1944 | Campbell | 101/115 |
| 3,877,371 | 4/1975 | Jaffa | 101/118 |
| 3,995,551 | 12/1976 | Mitter | 101/118 |
| 4,030,411 | 6/1977 | Zimmer | 101/118 |

FOREIGN PATENT DOCUMENTS

| | | | |
|---|---|---|---|
| 2155938 | 5/1972 | Fed. Rep. of Germany | 101/118 |
| 1350812 | 4/1974 | United Kingdom | 101/120 |

*Primary Examiner*—Clyde L. Coughenour
*Assistant Examiner*—William L. Klima
*Attorney, Agent, or Firm*—Karl F. Ross; Herbert Dubno

[57] ABSTRACT

A screen printing apparatus utilizes a number of screen printing heads disposed along a transport path for the fabric; each of the heads moves upwardly on a respective carrier so as to be tiltable by a pneumatic cylinder with respect to the carrier which is vertically displaceable in common with the other carriers by the displacement of a common element connecting wedges together. The carriers each have extensions provided with rollers which ride upon ramp surfaces of the respective wedges. The vertical displacement compensates for changes in diameter of the screen printing patterns and for changes in thicknesses of the webs processed.

7 Claims, 3 Drawing Figures

MULTIPLE UNIT APPARATUS FOR THE TREATMENT OF WEBS OF MATERIAL

CROSS REFERENCE TO RELATED APPLICATIONS

Our present application relates to the commonly owned copending applications Ser. Nos. 613,594 and 614,412 filed May 23, 1984 and May 25, 1984, respectively.

FIELD OF THE INVENTION

Our invention relates to the treatment of webs of material in a succession of treatment heads utilizing a cylindrical web-treating member. More particularly, the invention relates to an apparatus for the printing of textile webs utilizing cylindrical members such as screen printing pattern drums and especially to an apparatus of this type in which the fabric to be printed passes in succession beneath a number of heads, each having such a drum for applying respective colors to the fabric.

BACKGROUND OF THE INVENTION

The use of round patterns, i.e. cylindrical screen printing drums, in the screen printing of fabrics is known, a blade or roller within the drum pressing the printing ink or dyestuff through the unobstructed surface regions of the drum to imprint the fabric with the corresponding color patterns.

Such printing systems are described in the aforementioned copending applications, for example, and in the art of the files thereof.

It is known to provide such rotatable patterns in respective heads which are disposed one after another along the longitudinal path of the fabric to be printed and to pass the fabric between these heads and a support so that, as the drum rolls over the fabric, the pattern is printed in the manner described.

The patterns must, of course, be replaceable and for this purpose it is known to swingably mount the heads on fixed pivots, thereby enabling the head to be swung upwardly to afford access to the pattern and to permit such replacement.

When, however, a pattern drum or cylinder is replaced by a pattern drum or cylinder of larger diameter, the cylinder of this latter drum shifts relative to the cylinder of the drum which it replaced, thereby varying the pattern repeat.

This requires adjustment of the entire apparatus to match the center-to-center spacing of the drums to the desired repeat.

OBJECTS OF THE INVENTION

It is the principal object of the present invention to provide an improved apparatus for the treatment of webs of material and most advantageously for the screen printing of fabric webs with round or cylindrical screen printing patterns, drums or cylinders, whereby these disadvantages are obviated.

Another object of this invention is to provide an improved apparatus for the screen printing of a fabric which facilitates access for replacement of the pattern drums and which also eliminates the need for complicated readjustment of the heads longitudinally of the path of the fabric.

SUMMARY OF THE INVENTION

These objects and others which will become apparent hereinafter are attained, in accordance with the invention, in an apparatus in which each of the heads is pivotally mounted on a respective carrier and these carriers have extensions that are formed with cam followers riding upon inclined plane surfaces of wedges mounted upon a common horizontal shiftable element which can be displaced to vary the height of the respective pivot upon replacement of the drums. In addition, each of the carriers is provided with an independently controllable element acting upon the head for independently and individually displacing same about the respective pivot to facilitate replacement of the pattern.

Thus, with the invention, all of the units or heads can be displaced by a single operation to compensate for change of the various patterns, thereby enabling the cylinder of the pattern to shift vertically upon such change without an offset in the longitudinal direction of the printing path. Additionally, each holder can be tilted individually to allow for passage of a seam or other thickness variation in the fabric web, the drums riding over the seam or thickness variation in succession.

The manual operations and adjustment of the printing units upon replacement of the printing patterns are significantly reduced and the material thickness and the repeat can be taken into account in such adjustment. In addition, the alignment of the printing pattern with the magnetic beam therebelow, when magnetic bias of the doctoring member is utilized in accordance with the principles of the aforementioned copending applications, is always ensured.

BRIEF DESCRIPTION OF THE DRAWING

The above and other objects, features and advantages of the present invention will become more readily apparent from the following discription, reference being made to the accompanying drawing in which.

SPECIFIC DESCRIPTION

Figure 1:
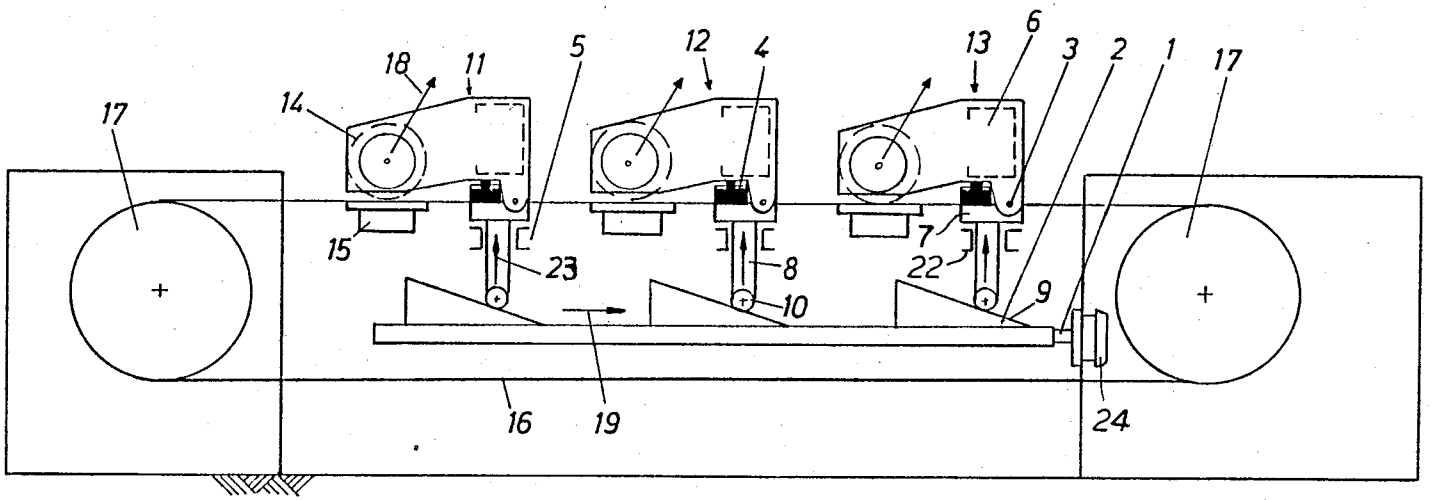
FIG. 1 is a schematic side-elevational view of an apparatus for printing a textile web with a number of round patterns and illustrating only the most important elements in a highly diagrammatic manner; elements not relevant to the instant invention have been omitted.

In the apparatus as seen in FIG. 1, three printing heads 11, 12, 13 are provided in succession along a printing path defined by a carrier constituted by an endless belt 16 passing over the drums 17.

Figure 2:
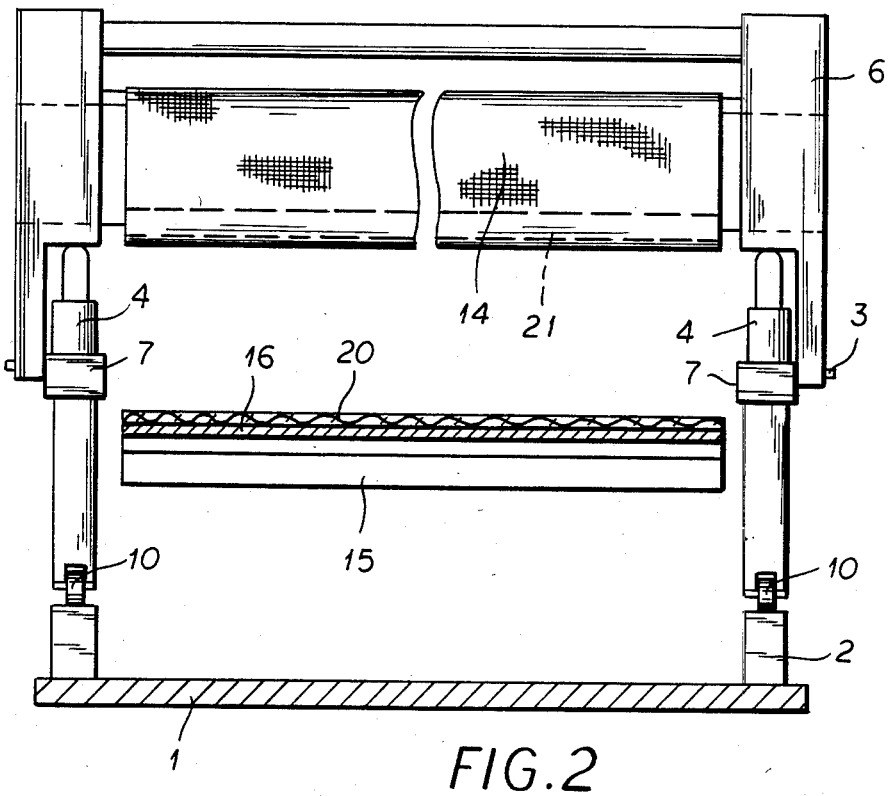
FIG. 2 is a diagrammatic vertical section through the apparatus of FIG. 1, showing one of the heads.

The fabric, not seen in FIG. 1 but represented at 20 in FIG. 2, is applied to the belt, e.g. by being adhesively bonded thereto with a readily releasable adhesive, and is carried by the belt past the three heads in succession so that respective colors in corresponding patterns and in appropriate registry are printed on the fabric. The fabric can be released from the support after traversing the array of heads.

The heads 11, 12 and 13 are each provided with a round (cylindrical) screen printing pattern 14 which cooperates with a magnetic beam below this pattern, the beam 15 urging a doctoring member represented at 21 (e.g. a roller or blade) downwardly so that ink is pressed through the pattern onto the fabric. The principles of such operation will be apparent from the aforementioned copending applications. The magnetic beam, therefore, forms a printing table and generally will have one or more magnets cooperating with the magnetically attractable member 21.

Each head comprises a holder 6 which is pivotally mounted at 3 on a carrier 7. The carriers 7, guided strictly vertically as represented by the guides 22, are displaceably vertical as represented by the arrows 23. The holders 6, in addition, are swingable about the pivots 3 as represented by the arrows 18 by pneumatic cylinders 4 mounted on the carriers 7 and acting on the holders 6.

Each carrier 7 is provided with a downward extension or bar 8 at the lower end of which a cam follower roller 10 is provided. For each cam follower roller we provide a wedge 2 on a common member 1 which can be hydraulically or pneumatically displaceable or locked by a control 24, the inclined surface or ramp 9 of each wedge supporting the respective roller 10.

For replacement of a printing drum, the pneumatic cylinder 4 thereof can be actuated to swing the head 11, 12 or 13 in the clockwise sense in FIG. 1 and upwardly as shown in FIG. 2, to afford access to the drum. This tilting mount also allows the head to follow thickness variations in the fabric as previously described.

Figure 3:
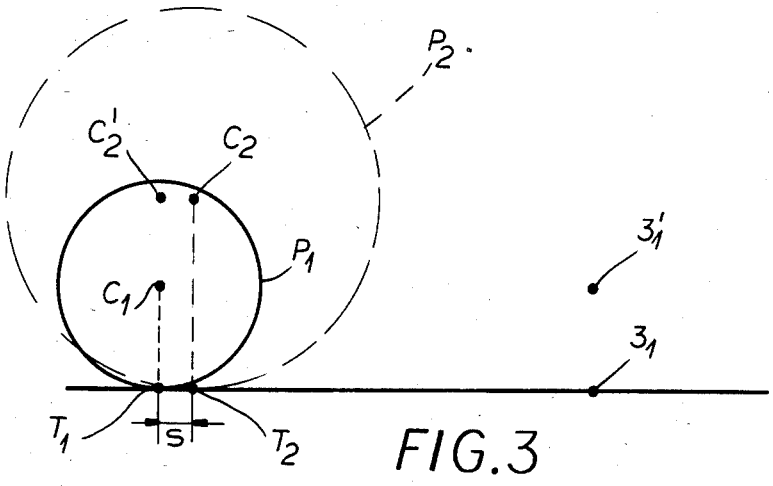
FIG. 3 is a diagram illustrating the principles of the invention.

When the patterns are changed (see FIG. 3), the member 1 is shifted to readjust the level of the pivots 3. For example, the pattern $P_1$ in FIG. 3 has a center $C_1$ and engages the fabric at a location $T_1$; the center $C_1$ can move in a clockwise sense about the pivot $3_1$ of its head.

If one were to replace this pattern $P_1$ by a pattern $P_2$ of larger diameter and with a center $C_2$ while retaining the pivot $3_1$ at its original location, the contact point of this drum would be located at $T_2$, i.e. would be shifted by the distance s from its original contact point.

However, by lifting the pivot $3_1$ to the position shown at $3_1'$ by a horizontal displacment of the respective wedge, the center $C_2$ is moved to a location $C_2'$ directly above the center $C_1$ so that the contact point is restored to the point $T_1$.

Accordingly, once a pattern change has been effected at all heads, the common member 1 is moved in the direction of the arrow 19 to simultaneously displace the pivots 3 of all of the heads 11, 12 and 13. A similar adjustment allows adjustment of the heads for substitution of fabrics with different thicknesses. The device 24 can lock the common member 1.

Clearly, the invention ensures that each of the patterns will always be precisely aligned with the respective magnetic beam 15.

The repeat setting means need not be provided on the machine itself but can be directly provided on the beam of the printing units and operations are greatly simplified because separate adjustment of the magnetic beam is not necessary.

We claim:

1. An apparatus for the treatment of a web of material which comprises:

means defining a substantially horizontal transport path for a web of material;

a plurality of treatment drums spaced apart along said path for successively treating each area of said web as said web is displaced along said path;

respective holders rotatably receiving said drums and disposed above said path;

respective carriers spaced apart in the direction of said path, each of said holders being pivotally connected to a respective one of said carriers, said carriers each having a respective extension;

respective wedges having inclined ramp surfaces engaging said extensions;

a common actuating member connected to all of said wedges for simultaneously displacing same to vertically adjust the positions of all of said carriers in common; and an individually controllable element associated with each holder for tilting same with reference to the respective carrier.

2. The apparatus defined in claim 1 wherein said web is a textile web and said drums are screen printing pattern drums disposed above respective magnet beams.

3. The apparatus defined in claim 1 wherein each of said extensions is provided with a roller riding on the respective ramp surface.

4. The apparatus defined in claim 1 wherein each of said elements is a pneumatic cylinder.

5. The apparatus defined in claim 4 wherein each of said cylinders is mounted on the respective carrier and has a piston acting upon the respective holder.

6. The apparatus defined in claim 1 wherein said common actuating member is a push or pull bar provided with means for locking it in position.

7. The apparatus defined in claim 5 wherein said common actuating member is a push or pull bar provided with means for locking it in position.

* * * * *